US010118406B2

(12) United States Patent
Moehringer et al.

(10) Patent No.: US 10,118,406 B2
(45) Date of Patent: Nov. 6, 2018

(54) CAROUSEL-TYPE PRINTING SYSTEM

(71) Applicant: HEIDELBERGER DRUCKMASCHINEN AG, Heidelberg (DE)

(72) Inventors: Markus Moehringer, Weinheim (DE); Bernhard Buck, Heidelberg (DE); Alexander Weber, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/473,923

(22) Filed: Mar. 30, 2017

(65) Prior Publication Data

US 2017/0282595 A1 Oct. 5, 2017

(30) Foreign Application Priority Data

Mar. 31, 2016 (DE) ..... 10 2016 205 266

(51) Int. Cl.
*B41J 3/407* (2006.01)
*B41J 2/01* (2006.01)

(52) U.S. Cl.
CPC ..... *B41J 3/4073* (2013.01); *B41J 2/01* (2013.01)

(58) Field of Classification Search
CPC .... B41J 13/106; B41J 13/103; B41J 13/0054; B41J 11/006; B41J 11/0065; B41J 11/007; B41J 11/02
See application file for complete search history.

(56) References Cited

U.S. PATENT DOCUMENTS

| | | | | |
|---|---|---|---|---|
| 6,244,307 | B1 | 6/2001 | Araki et al. | |
| 2002/0097280 | A1 | 7/2002 | Loper et al. | |
| 2015/0283751 | A1* | 10/2015 | O'Neil | B29C 47/043 264/308 |
| 2016/0068355 | A1 | 3/2016 | Clusserath | |

FOREIGN PATENT DOCUMENTS

| | | | |
|---|---|---|---|
| DE | 1084275 | A | 6/1960 |
| DE | 102013104082 | A1 | 10/2014 |
| DE | 102013112656 | A1 | 5/2015 |
| EP | 0673835 | A1 | 9/1995 |
| JP | H10-305802 | A | 11/1998 |

* cited by examiner

*Primary Examiner* — Kristal Feggins
(74) *Attorney, Agent, or Firm* — Laurence A. Greenberg; Werner H. Stemer; Ralph E. Locher

(57) ABSTRACT

A carousel-type printing system includes a plurality of printing units for printing on objects and a revolver for conveying the objects from one of the printing units to another. The revolver has a plurality of spindles with retaining elements for holding the objects. A first shaft and a first motor are provided for rotating the revolver. A second shaft and a common second motor are provided for rotating the spindles. One of the two shafts is a hollow shaft and the other of the two shafts is an interior shaft in the hollow shaft. The first motor and the second motor are preferably coaxial with one another.

9 Claims, 2 Drawing Sheets

CAROUSEL-TYPE PRINTING SYSTEM

CROSS-REFERENCE TO RELATED APPLICATION

This application claims the priority, under 35 U.S.C. § 119, of German Application DE 10 2016 205 266.7, filed Mar. 31, 2016; the prior application is herewith incorporated by reference in its entirety.

BACKGROUND OF THE INVENTION

Field of the Invention

The present invention relates to a carousel-type printing system including a plurality of printing units and a revolver for conveying the objects from one printing unit to another.

Printing systems of that type are used to print on non-planar objects such as balls or cups, which may be referred to as three-dimensional objects or as objects having curved surfaces.

U.S. Patent Application US 2002/0097280 A1 discloses a carousel-type printing system. That prior art system has a motor for rotating a revolver and a plurality of motors for rotating object retaining elements. Every retaining element has its own motor, a fact which is unfavorable in terms of manufacturing costs.

SUMMARY OF THE INVENTION

It is accordingly an object of the invention to provide a carousel-type printing system, which overcomes the hereinafore-mentioned disadvantages of the heretofore-known systems of this general type.

With the foregoing and other objects in view there is provided, in accordance with the invention, a carousel-type printing system, comprising a plurality of printing units for printing on objects, a revolver for conveying the objects from one printing unit to another, the revolver having a plurality of spindles with retaining elements for holding the objects, a first shaft and a first motor for rotating the revolver, and a second shaft and a common second motor for rotating the spindles, in which one of the two shafts is a hollow shaft and the other of the two shafts is an interior shaft in the hollow shaft.

The reduced number of motors allows the printing system of the invention to be manufactured in a cost-efficient way. An additional advantage is that because of their reduced number, controlling the motors is less complex.

In accordance with another development, the first motor and the second motor are disposed to be coaxial with one another.

In accordance with a further development, the first shaft is the hollow shaft and the second shaft is the interior shaft.

In accordance with an added development, a transmission is provided as a driving connection between the second shaft and the spindles. The transmission may be a bevel gear drive.

In accordance with an additional development, the transmission includes a common central wheel and gears disposed on the spindles and meshing with the common central gear. In this case, the common central wheel is a gearwheel. Friction wheels in friction wheel contact with the common central wheel may be disposed on the spindles instead of the gearwheels. In this case, the common central wheel is a friction wheel. In both cases (gear drive, friction wheel drive), the common central wheel may be located on the second shaft.

In accordance with yet another development, the printing units are inkjet printing units.

In accordance with a concomitant development, the first motor and the second motor are controlled in such a way that when the revolver advances in a timed manner, both motors actively rotate at the same time. In this case, the second motor may be controlled in such a way that when the revolver advances in a timed manner, the motor overcompensates for a rotation of the spindles caused by the advance.

Other features which are considered as characteristic for the invention are set forth in the appended claims.

Although the invention is illustrated and described herein as embodied in a carousel-type printing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
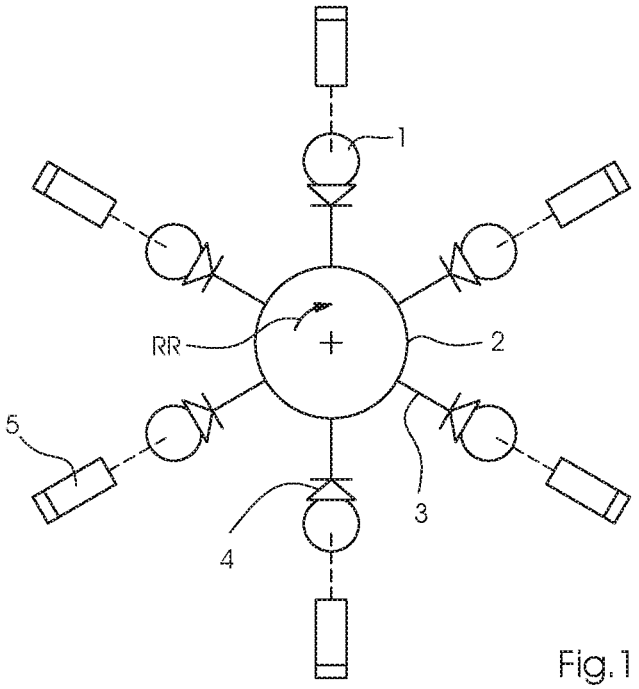
FIG. 1 is a diagrammatic plan view of a printing system including inkjet printing units disposed in an annular configuration about a transport revolver.

Referring now to the figures of the drawings in detail and first, particularly, to FIG. 1 thereof, there is seen a carousel-type printing system for printing on non-planar objects 1 such as balls. Printing units 5 are disposed on a circle around a revolver 2 and simultaneously print on the objects 1 in an inkjet printing process. Every object 1 is successively transported to every printing unit 5 in a timed revolver rotation RR. The objects 1 are held in retaining elements 4 on spindles 3 by a vacuum or clamping mechanism. The spindles 3 are disposed on the revolver 2 in a stellar configuration, with the printing units 5 and the spindles 3 defining identical circle graduation.

In a modification that is not illustrated in the drawing, one of the printing units 5 is replaced by a loading and/or unloading unit.

Figure 2:
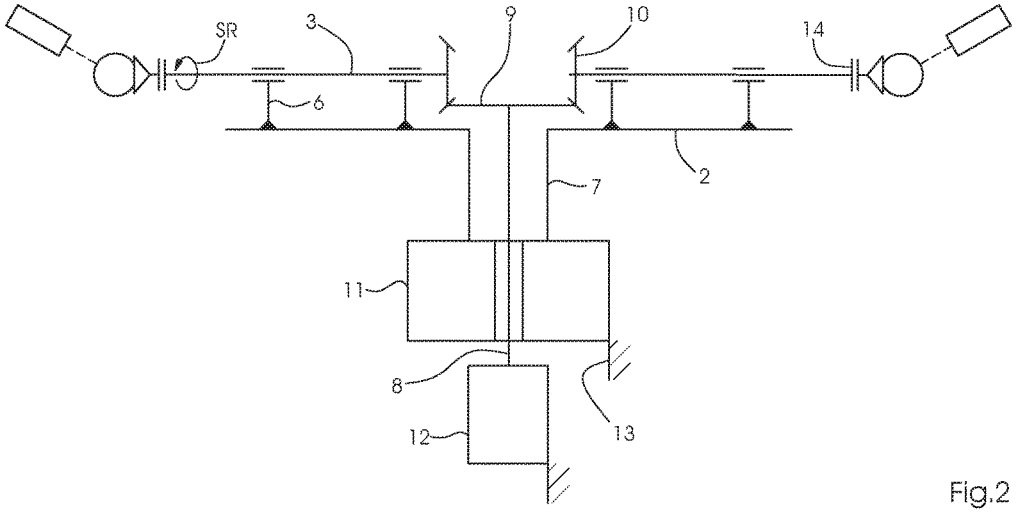
FIG. 2 is a sectional view of the transport revolver and its mechanical drive system.

FIG. 2 is a sectional view of the revolver 2. The spindles 3 are supported for rotation in supports 6 on the revolver 2 and are aligned at right angles relative to a hollow shaft 7 and an interior shaft 8, which may also be referred to as the first shaft 7 and the second shaft 8. The spindles 3 are horizontal spindles and the shafts 7, 8 are vertical shafts. The hollow shaft 7 is disposed to be coaxial with a first motor 11 or the motor shaft thereof and is connected thereto for co-rotation. The interior shaft 8 is disposed to be coaxial with a second motor 12 or the motor shaft thereof and is connected thereto for co-rotation. The motors 11, 12 are disposed to be coaxial with one another and are constructed as electric motors.

The hollow shaft 7 transmits the rotation of the first motor 11 to the revolver 2 in order for the latter to carry out a revolver rotation RR. The first motor 11 is a direct drive of the revolver 2. The interior shaft 8 is disposed inside the hollow shaft 7 and extends from the second motor 12 through the hollow shaft 7 to a transmission that is disposed on the side of the hollow shaft 7 opposite the second motor 12. Rotation of the second motor 12 is transmitted to the spindles 3 by the interior shaft 8 and the transmission to cause every one of the spindles 3 to carry out a spindle rotation SR.

The transmission includes a central wheel 9 at the end of the interior shaft 8 and gears 10 meshing with the central wheel 9. The second motor 12 is a direct drive of the central wheel 9. Every gear 10 is disposed at the end of a different spindle 3. The pitch diameter of the central wheel 9 is substantially greater than the pitch diameter of the gears 10. The transmission is a bevel gear drive and the central wheel 9 and the gears 10 are bevel gears. The motors 11, 12 are fixed to a frame 13, for instance in that the revolver 2 is disposed in the frame 13 so as to be movable by using a vertical linear guide.

It is possible, but not mandatory, for every retaining element 4 to be connected to the respective spindle 3 by using a friction clutch 14. The friction clutches 14 would allow the revolver 2 to be loaded with as-yet unprinted objects 1 during an ongoing printing operation. The respective friction clutch 14 would slip when the operator removes a printed object 1 from the retaining element 4 associated with the friction clutch 14 in question and loads an unprinted object 1 into the retaining element 4. During an object change, the retaining element 4 does not rotate although the associated spindle 3 continues to rotate.

The printing system operates as follows: the printing units 5 successively print different colors or images onto every object 1. Once a processing step has been completed, the revolver 2 advances to the next unit in a timed way to move the respective object 1 to the next printing unit 5.

Such a timed advance would cause the spindles 3 holding the objects 1 to rotate in an undesirable way if the central wheel 9 was at a standstill and the gears 10 would roll off thereon. In order to avoid this, both motors 11, 12 are operated simultaneously as the revolver 2 advances. The first motor 11 drives the revolver rotation RR, effecting the actual timed advance. The second motor 12 causes the spindles 3 to rotate, a rotation which is superimposed on the rotation of the spindles 3 caused by the first motor 11.

The transmission acts as a summation gearbox with two input movements (hollow shaft 7, interior shaft 8) and a resultant output movement of every spindle 3.

In this process, the second motor 12 is controlled in such a way that it does not merely compensate for the revolver rotation RR, i.e. it does not merely cause the spindles 3 to come to a standstill, but overcompensates. This means that the spindle rotation SR through a specific angle of rotation, which occurred during the previous processing step, is reversed. As a consequence, at the beginning of the next processing step, every spindle 3 is in the same starting position in terms of its angle of rotation as it was at the beginning of the previous processing step. Thus, for every processing step in every printing unit 5, the same circumferential gear section of the gears 10 rolls on the central wheel 9, a fact that is advantageous in terms of taking a transmission error of the transmission into consideration. The transmission error is the same for every spindle 3 at every printing unit 5. The transmission error in the printed image is not as conspicuous as it would be without overcompensation.

The invention claimed is:

1. A carousel-type printing system, comprising:

a plurality of printing units for printing on objects;

a revolver for conveying the objects from one of said printing units to another of said printing units, said revolver having a plurality of spindles with retaining elements for holding the objects;

a first shaft and a first motor for rotating said revolver;

a second shaft and a second motor for rotating said spindles in common;

one of said two shafts being a hollow shaft and the other of said two shafts being an interior shaft in said hollow shaft; and said first motor and said second motor being controlled to both actively rotate at the same time when said revolver advances in a timed manner.

2. The printing system according to claim 1, wherein said first motor and said second motor are coaxial with one another.

3. The printing system according to claim 1, wherein said first shaft is said hollow shaft and said second shaft is said interior shaft.

4. The printing system according to claim 1, which further comprises a transmission providing a driving connection between said second shaft and said spindles.

5. The digital printing system according to claim 4, wherein said transmission is a bevel gear mechanism.

6. The printing system according to claim 4, wherein said transmission includes a common central wheel and gears, said gears each being disposed on a respective one of said spindles and said gears meshing with said common central wheel.

7. The printing system according to claim 6, wherein said common central wheel is disposed on said second shaft.

8. The printing system according to claim 1, wherein said printing units are inkjet printing units.

9. The printing system according to claim 1, wherein said second motor is controlled to overcompensate a rotation of said spindles caused by an advance of said revolver when said revolver advances in a timed manner.

* * * * *